US008333331B1

(12) United States Patent
Fuller et al.

(10) Patent No.: US 8,333,331 B1
(45) Date of Patent: Dec. 18, 2012

(54) LAMINAR BELL WATER DISPLAY

(75) Inventors: Mark W. Fuller, Toluca Lake, CA (US); James Doyle, Los Angeles, CA (US); Helen Park, La Crescenta, CA (US); Riae Yoo, Glendale, CA (US); Michael Jason Baldwin, Van Nuys, CA (US); Keith Kalis, Lancaster, CA (US); John Edmark, Stanford, CA (US)

(73) Assignee: Wet Enterprises, Inc., Sun Valley, CA (US)

( * ) Notice: Subject to any disclaimer, the term of this patent is extended or adjusted under 35 U.S.C. 154(b) by 832 days.

(21) Appl. No.: 11/620,596

(22) Filed: Jan. 5, 2007

Related U.S. Application Data

(60) Provisional application No. 60/756,666, filed on Jan. 6, 2006.

(51) Int. Cl.
*B05B 17/08* (2006.01)

(52) U.S. Cl. ..... 239/17; 239/18

(58) Field of Classification Search ..... 239/17–20, 239/23

See application file for complete search history.

(56) References Cited

U.S. PATENT DOCUMENTS

| | | | | |
|---|---|---|---|---|
| 1,593,853 | A * | 7/1926 | Smith et al. | 239/23 |
| 1,685,830 | A * | 10/1928 | Schidorsky | 239/23 |
| 6,705,540 | B2 * | 3/2004 | Koshiyama et al. | 239/17 |
| 6,871,793 | B2 * | 3/2005 | Rumens et al. | 239/16 |

OTHER PUBLICATIONS

Brunet, P., et al., Transonic Liquid Bells, Jun. 4, 2004, pp. 2668-2678, Physics of Fluids, vol. 16, No. 7, American Institute of Physics [DOI: 10,1063/1.1738650].

Clanet, C., Dynamics and Stability of Water Bells, 2001, pp. 111-147, J. Fluid Mech., vol. 430, Cambridge University Press.

Clanet, C., Stability of Water Bells Generated by Jet Impacts on a Disk, Dec. 11, 2000, pp. 5106-5109, Physical Review Letters, vol. 85, No. 24, The American Physical Society.

* cited by examiner

*Primary Examiner* — Davis Hwu
(74) *Attorney, Agent, or Firm* — Blakely, Sokoloff, Taylor & Zafman

(57) ABSTRACT

A decorative water display provides a laminar water bell. A gas burner may be provided inside the laminar water bell to produce a decorative flame. A laminar nozzle having an outlet arranged to eject a laminar jet of water upwardly in a substantially vertical direction may strike an impactor suspended directly above the outlet of the laminar nozzle such that the laminar jet of water forms the laminar water bell. Alternatively, a vertical pipe may supply water to a thin annular region between two plates such that water flowing between the two plates assumes a generally laminar flow characteristic and forms the laminar water bell when ejected from between the two plates. Alternatively, a hemispherical nozzle may have a slot arranged to eject a sheet of water upwardly to form a segment of the laminar water bell.

17 Claims, 7 Drawing Sheets

LAMINAR BELL WATER DISPLAY

CROSS REFERENCE TO RELATED APPLICATIONS

This application claims priority from U.S. Provisional Application Ser. No. 60/756,666, filed Jan. 6, 2006.

BRIEF DESCRIPTION OF THE DRAWINGS

The present invention is illustrated by way of example and not limitation in the figures of the accompanying drawings, in which like references indicate similar elements and in which.

DETAILED DESCRIPTION

The claimed invention provides a variety of water displays based on various forms of laminar water bells. A laminar water bell is a sheet of water that is ejected from a nozzle or impactor having a generally disc-like form. The water leaves the nozzle or impactor in a generally horizontal direction with laminar flow characteristics. For the purposes of this invention, the flow may not be perfectly laminar. It is sufficient to have a flow with low enough turbulence to produce a sheet of water that exhibits the characteristics described herein. The force of gravity pulls the water in a downward direction and the laminar sheet of water assumes a bell-like shape. It should be recognized that the laminar (or nearly laminar) sheet of water may become turbulent as it travels through the air and this may cause the water bell to break up into water drops. This breaking up of the laminar water bell as it becomes turbulent may contribute to the aesthetic result of the water display.

Figure 1A:
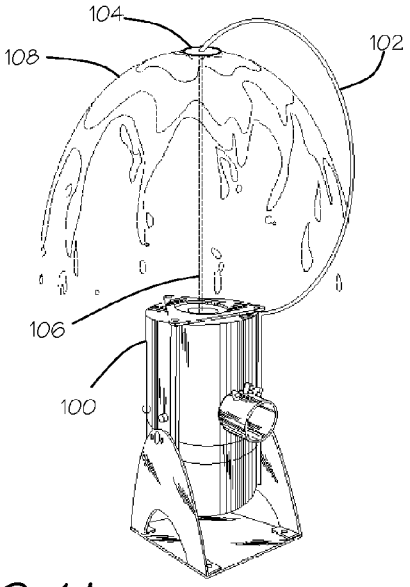
FIG. 1A is a pictorial view of a water display with a laminar water bell in a first configuration.

FIG. 1A shows an embodiment using a laminar nozzle 100. The laminar nozzle ejects a laminar jet 106 upward in a substantially vertical direction to impinge on the under side of an impactor 104 suspended directly above the outlet of the laminar nozzle 100. The impactor 104 may be held in the necessary location by a support 102 that couples the impactor 104 to the laminar nozzle 100. The underside of the impactor 104 may have a smooth lower surface and a relatively sharp edge at its outer periphery to facilitate maintaining the laminar flow of the water.

By impinging the laminar jet 106 substantially perpendicular to the center of the impactor 104, the water will retain its laminar flow characteristics as it sharply changes directions from an upwardly vertical trajectory to a horizontal trajectory. Thus, a laminar sheet of water 108 is ejected from the impactor 104 in a sheet that extends from the impactor substantially horizontally and symmetrically in all directions.

Figure 1B:
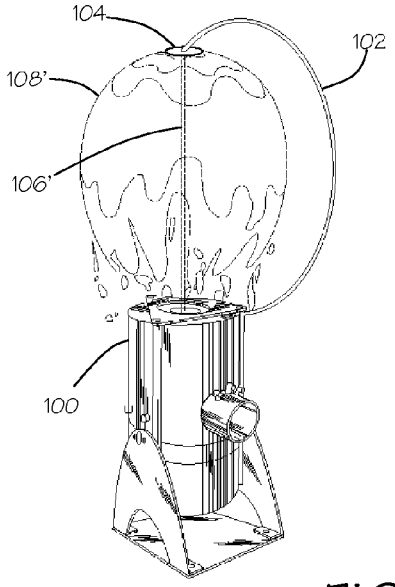
FIG. 1B is a pictorial view of a water display with a laminar water bell in a second configuration.

The downward force of gravity will then cause the laminar sheet 108 to assume a variety of bell-like shapes depending on the velocity of the laminar jet 106. As shown in FIG. 1A, when the laminar jet 106 has a relatively high velocity the laminar water bell 108 will be flatter and will tend to break up into water droplets relatively high up in the trajectory producing an umbrella-like shape as shown by FIG. 1B.

A laminar jet 106' with a lower velocity will produce a laminar sheet 108' that is more bell-like in form as it is pulled in a downward direction by gravity. In this case, the water bell 108' will assume a more bell-like or lantern-like form where the lower edge of the water bell may curve inwardly from the maximum outward travel of the laminar sheet before the laminar sheet breaks up into water droplets.

Figure 2:
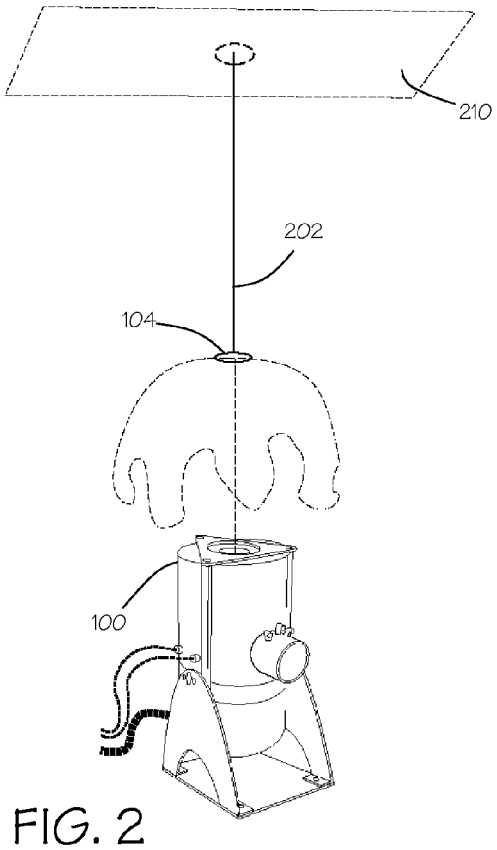
FIG. 2 is a pictorial view of a water display with a first configuration for supporting an impactor.
Figure 3:
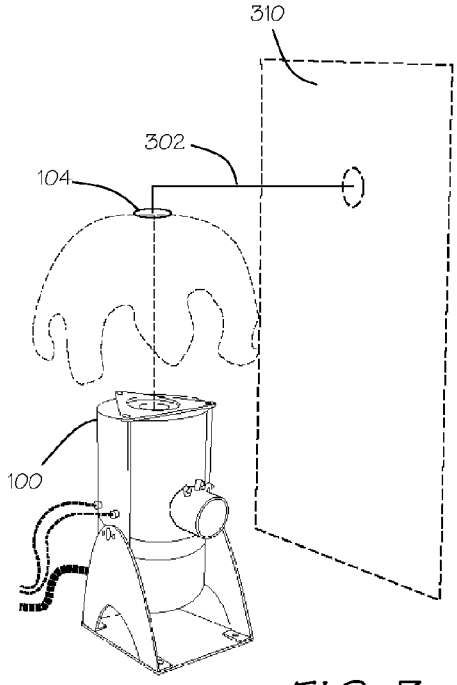
FIG. 3 is a pictorial view of a water display with a second configuration for supporting an impactor.

As shown by FIG. 2, the impactor 104 may be supported by a rod 202 connected to a ceiling 210 or other structure located above the laminar nozzle 100. As shown in FIG. 3, the impactor 104 may also be supported by a horizontal support arm 302 extending from a vertical wall 310 adjacent the laminar nozzle 100. It will be appreciated that it is necessary to provide a relatively rigid support for the impactor 104 to avoid movement or vibration that would disturb the laminar flow characteristics of the laminar water jet 106 of being impacted to produce the laminar water bell. The supports shown merely illustrate some possible support systems for the impactor 104 and many other forms of support may be used in many other positions as part of the inventive water display.

Figure 4:
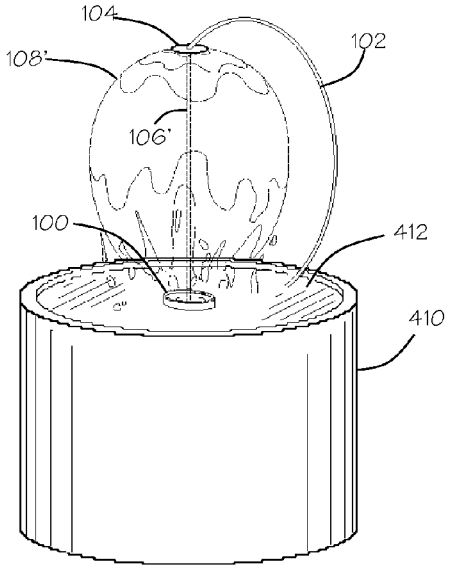
FIG. 4 is a pictorial view of another configuration a water display.

As shown in FIG. 4, the laminar flow nozzle 100 may be contained within a tub 410 or can or other container capable of collecting the water droplets from the water bell 108' as it breaks up and falls towards the laminar nozzle 100. The tub 410 or container may be provided with a surface 412 to obscure the laminar nozzle mechanism 100 and other equipment such as a re-circulating pump that may be contained with in the tub 410. The surface 412 may be a porous or perforated surface such as wire screen, or it may be a decorative surface, such as stones through which the water may flow. In another embodiment, the upper surface of the tub 412 may be a shallow pool of water with a black bottom that, in turn, drains to the lower portion of the tub 410 to be recirculated through the laminar nozzle 100. It will be noted that the laminar nozzle 100 may project above the surface 412 of the tub 410. It is desirable that the laminar jet 106' emerge from the tub 410 without disturbance to the laminar flow. Thus, it may be desirable to provide a barrier to any surrounding materials, particularly, a pool of water, so that the laminar jet 106' does not become turbulent by reason of having to emerge through other materials.

Figure 5:
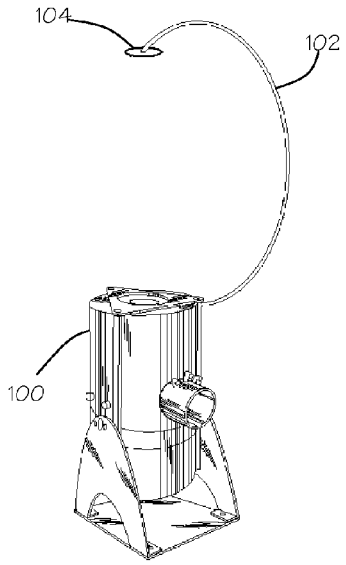
FIG. 5 is a pictorial view of a portion of the water display of FIG. 4.
Figure 6:
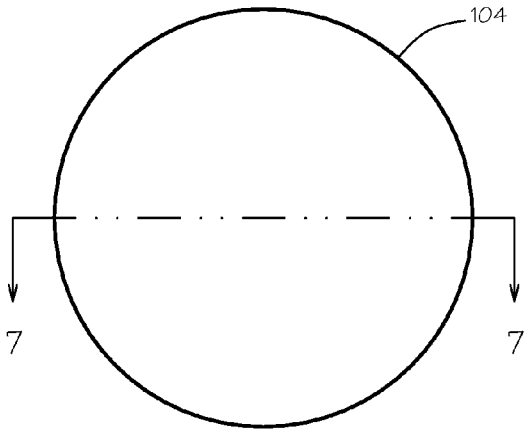
FIG. 6 is a plan view of an impactor.
Figure 7:
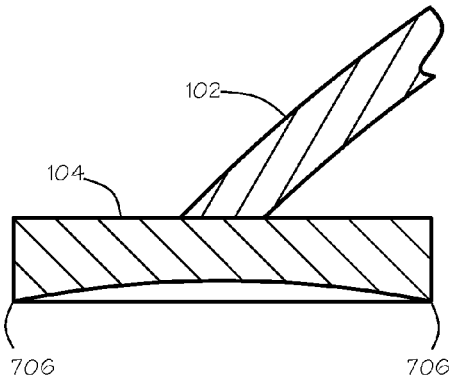
FIG. 7 is a section view of the impactor along section line 6-6.

FIG. 5 shows the laminar nozzle 100, the support bracket 102, and the impactor disk 104 without water so that the mechanism of the water display can be more clearly seen. FIG. 6 is a bottom view of the impactor 104 and FIG. 7 is a cross-section of the impactor 104 taken along section line 7-7. In some embodiments, the lower surface of the impactor 104 that the laminar jet will impinge may have a slightly concave shape to aid in the formation of the desired water bell shape. For example, the impactor may have a diameter of 2 to 3 inches and the bottom surface may have a maximum depth at the center of the impactor of ⅛ inch. In other embodiments, the impactor may have other diameters, the bottom surface may be flat, or have other shapes that deviate slightly from a flat surface. It may be desirable to provide a relatively sharp corner 706 at the outer periphery of the impactor so that the laminar sheet 108 will separate from the impactor more cleanly.

Figure 8:
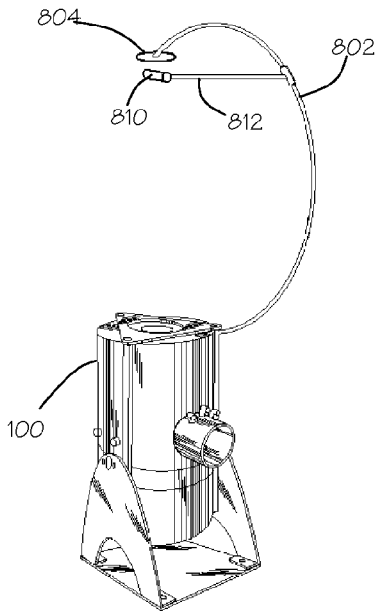
FIG. 8 is a pictorial view of a water display with a burner assembly.

FIG. 8 shows another embodiment that adds a burner 810 to the water display. The burner 810 may be connected to a source of flammable gas, such as natural gas or propane, by a supply connection 812. The support 802 for the impactor 804 may form part of the gas supply for the burner 810. It will be noted that the supply connection 812 passes through the water bell 908 which will cause a "tear" in the water bell. The tear will generally be on the side of the water bell away from the viewer and may not unduly detract from the appearance of the water bell.

Figure 9:
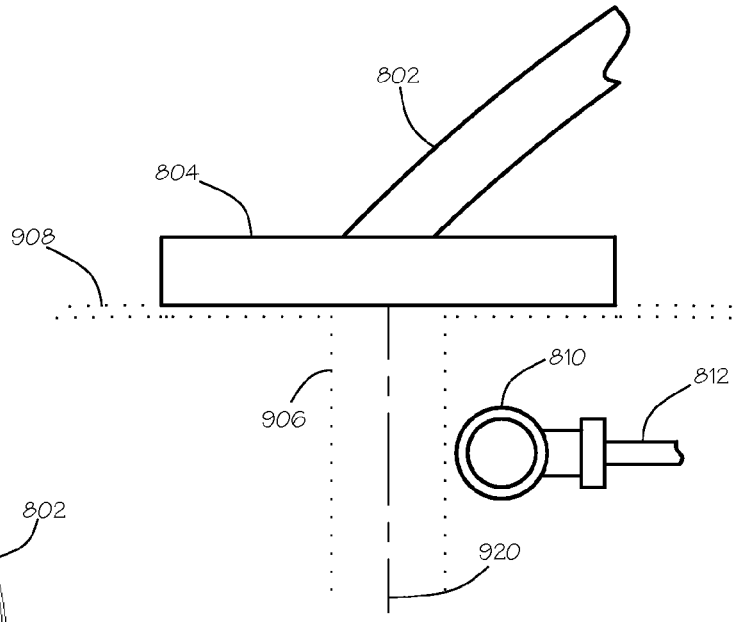
FIG. 9 is a side view of the burner assembly of FIG. 8.
Figure 10:
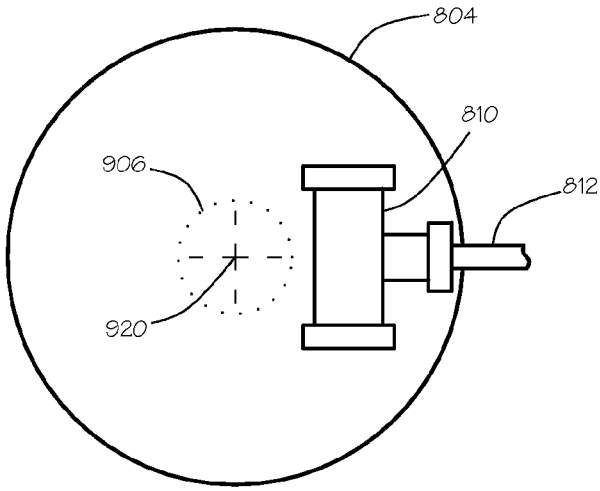
FIG. 10 is a bottom view of the burner assembly of FIG. 8.

FIG. 9 is a side view of the burner 810 and impactor 804. It will be noted that the burner 810 is spaced apart from the center 920 of the impactor 804 so that the laminar jet 906 does not strike the burner 810. FIG. 10 shows the relationship of the burner 810 to the impactor 804 and the laminar jet 906 in a bottom view.

Figure 11A:
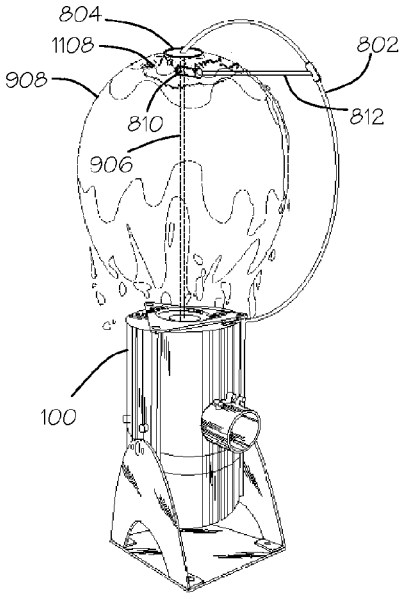
FIG. 11A is a pictorial view of a water display with a burner operating in a first configuration.
Figure 11B:
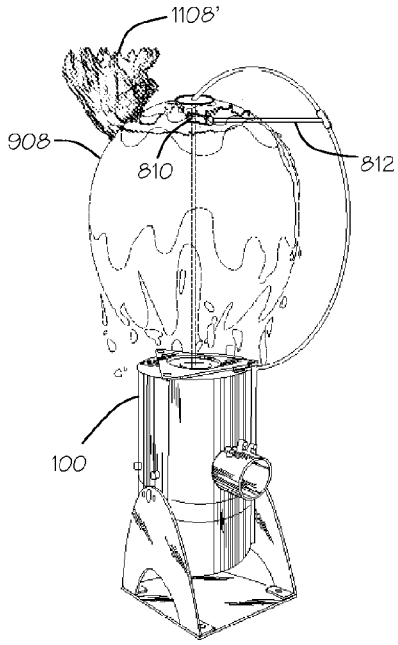
FIG. 11B is a pictorial view of a water display with a burner operating in a second configuration.

By igniting gas that flows to the burner 810, a display that combines a laminar water bell 908 and a flame 1108 may be obtained as illustrated by FIG. 11A. If the gas is provided at a relatively low flow rate, the resulting flame 1108 may be entirely contained within the water bell 908 providing a "water lantern" effect. As illustrated in FIG. 11B, if the gas is provided at a higher flow rate, the flame 1108' may break through the laminar water bell 908 producing a more dynamic display where the flames periodically break through the water bell 908 in various locations around the water bell.

Figure 12:
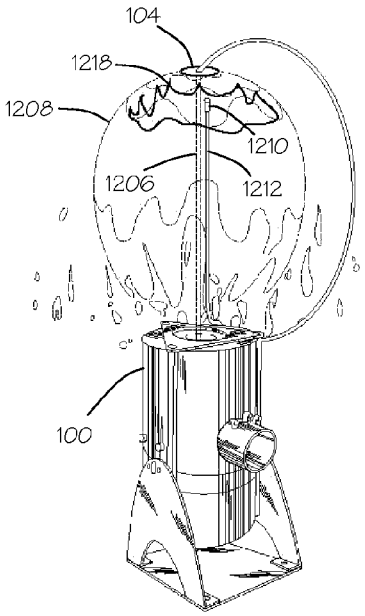
FIG. 12 is a pictorial view of a water display with a burner operating in a third configuration.

FIG. 12 illustrates another embodiment of a burner 1210. The burner is supported by a substantially vertical supply line 1212. The supply line 1212 may be routed into the water bell from the bottom below the level at which the bell breaks up into water drops. The supply line 1212 may then be routed vertically parallel and close to the laminar water jet 1206. The supply line may be relatively inconspicuous because of its proximity to the laminar water jet 1206. The flame 1218 produced by the burner may be substantially similar to the flames previously described in connection with FIGS. 11A and 11B. Routing the supply line 1212 from the bottom may be advantageous because the gas may be better contained by a water bell without the tear caused by passing the supply line through the water bell. While the burner 1210 is shown near the top of the water bell 1208, close to the impactor 104, the burner may be placed at a lower position within the water bell.

Figure 13:
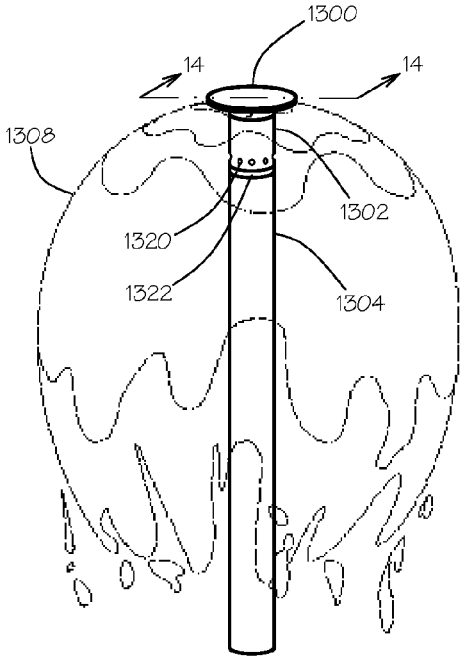
FIG. 13 is a pictorial view of another configuration of a water display.

FIG. 13 shows another water display providing a water bell.

Figure 14:
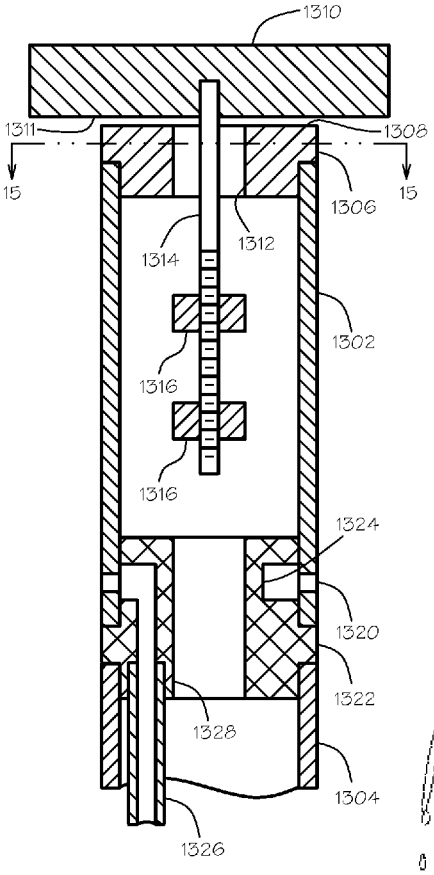
FIG. 14 is a side section of the upper portion of FIG. 13 along section line 14-14.

Vertical pipes 1304, 1302 may provide a flow of water to a nozzle 1300 located at the upper end of the pipe. FIG. 14 shows a cross-section of the upper end of the pipe 1302 with the attached nozzle. The nozzle includes a lower plate 1306 that is attached to the upper end of the pipe 1302 and an upper plate 1310 that is located above the lower plate forming a thin annular region between the two plates. The lower plate 1306 includes a circular hole 1312 through which the water supplied by the pipe 1302 can flow upwardly into the nozzle. The upper surface 1308 of the lower plate 1306 and the lower surface 1311 of the upper plate 1310 are both smooth and the outer periphery of each plate may have a relatively sharp edge. As the water flows through the thin annular region formed between the two plates 1306, 1310, the flow assumes a generally laminar flow characteristic. As the water is ejected from the edge of the upper plate 1310, the desired laminar water bell 1308 may be formed.

Figure 16:
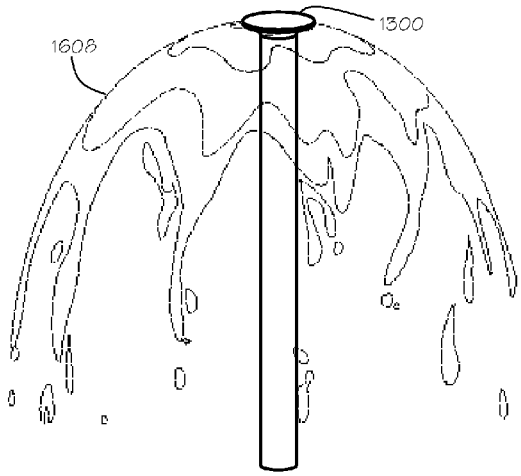
FIG. 16 is a pictorial view of the water display of FIG. 13 with the laminar water well in another configuration.

The upper plate 1310 may be supported by a threaded rod 1314 that is coupled to a support 1316 within the pipe 1302. This may provide a mechanism for adjusting the distance between the lower plate 1306 and the upper plate 1310. When the space between the two plates is relatively wide, the velocity of the laminar sheet being ejected from the upper plate 1310 may be relatively low and the closed "water lantern" as shown in FIG. 13 may be formed. If the space between the two plates is relatively narrow, the laminar sheet will be ejected from the nozzle 1300 with a higher velocity forming the more open umbrella shaped water bell 1608 shown in FIG. 16.

Figure 15:
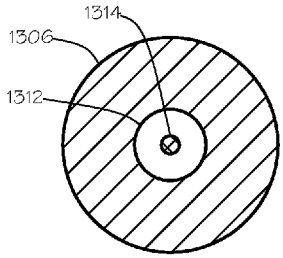
FIG. 15 is a section view along section line 15-15.

FIG. 15 shows a cross-section of the lower plate 1306 with the circular passage 1312 through which water flows into the thin annular area of the nozzle area assembly. The threaded support 1314 can be seen passing through the circular opening 1312. It is not necessary that the water being supplied to the nozzle have a laminar flow characteristic. Therefore, it is possible to use a smaller diameter of supply pipe 1302 and to place structures such as the threaded support rod 1304 in the flow path. The outer surfaces of the supply pipes 1302, 1304, and nozzle plates 1310, 1306, may be provided with a shiny surface such as chrome plating to make them less conspicuous within the water bell display.

The upper end of the supply pipe 1302 may include a burner assembly to provide a combination of fire with the water bell in a manner similar to that shown previously in FIGS. 11 and 12. As shown by the cross-section of FIG. 14, the burner assembly may be provided by providing one or more openings 1320 in the wall of the upper end of the water supply pipe 1302. A gas distribution manifold 1322 may be placed within the water supply pipes 1302, 1304. The gas manifold 1322 may provide a channel 1324 that distributes gas supplied from a gas supply line 1326 to the channel 1324 and thence to the orifices 1320. The gas manifold 1322 may include a through passage 1328 to allow the water to pass upwardly through the gas manifold to the nozzle plates 1306, 1310.

Figure 22:
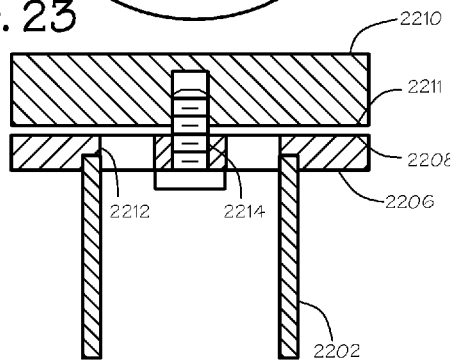
FIG. 22 is another configuration for the side section of the upper portion of FIG. 13.

FIG. 22 shows a cross-section of another nozzle that is similar to the nozzle of FIGS. 13 through 16. The nozzle includes a lower plate 2206 that is attached to the upper end of the pipe 2202 and an upper plate 2210 that is located above the lower plate forming a thin annular region between the two plates. The two plates may have a substantially similar diameter which is substantially greater than the diameter of the pipe 2202. The lower plate may have an opening with substantially the same diameter as the inside diameter of the pipe 2202 through which the water supplied by the pipe can flow upwardly into the nozzle.

The upper surface 2208 of the lower plate 2206 and the lower surface 2211 of the upper plate 2210 are both smooth and the outer periphery of each plate may have a relatively sharp edge. As the water flows through the thin annular region formed between the two plates 2206, 2210, the flow assumes a generally laminar flow characteristic. As the water is ejected from the edge of the plates 2206, 2210, the desired laminar water bell may be formed. The upper plate 2210 may be supported by a threaded member 2214 that is coupled to the lower plate. This may provide a mechanism for adjusting the distance between the lower plate 2206 and the upper plate 2210.

Figure 23:
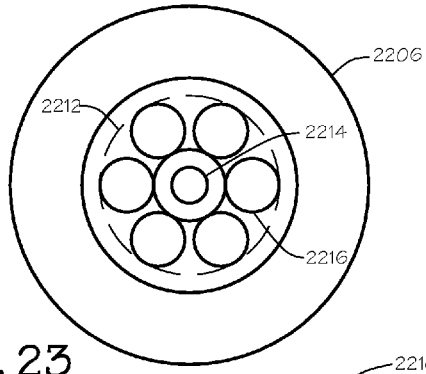
FIG. 23 is a top view of a portion of the assembly of FIG. 22.

FIG. 23 shows a bottom view of the lower plate 2206. The passage 2212 through which water flows into the thin annular area of the nozzle area assembly may be formed by a series of closely spaced holes 2216 as shown. The threaded member 2214 may be supported by a central portion of the lower plate.

Figure 17:
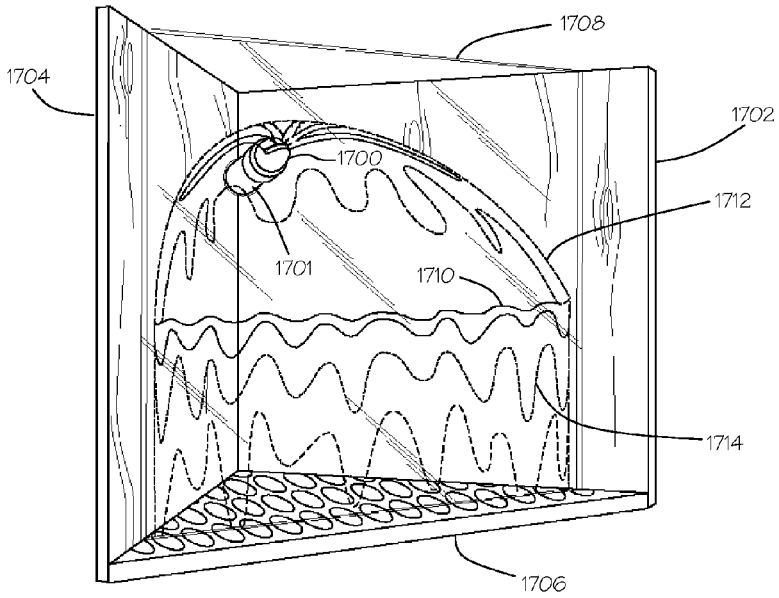
FIG. 17 is pictorial view of another configuration of a water display.

FIG. 17 shows another water display providing a water bell. A nozzle 1700 in the form of a hemisphere shell with a slot provides two knife edges that define the slot. The knife edges may have their acute angle on the inside of the hemispherical shell. The nozzle 1700 may be installed in the end of a supply pipe 1701. Water supplied to the nozzle 1700 by the supply pipe 1701 is ejected from the slot of the nozzle 1700 with laminar flow characteristics. The laminar sheet 1712 thus formed may emerge with a pattern that is a segment of a circle fanning out from the nozzle 1700. The laminar sheet 1712 may provide a segment of a water bell.

In the embodiment shown in FIG. 17 the nozzle 1700 is installed in the corner of two walls 1702, 1704. A glass panel 1708 provides a transparent front wall opposite the nozzle 1700. A perforated or porous floor 1706 may be provided. There may be a sump (not shown) below the porous floor 1700 to collect the water emitted by the nozzle 1700. The sump may include a recirculation pump to provide water to the supply pipe 1701 and the nozzle 1700. The nozzle and the glass panel 1708 may be arranged so that the water bell 1712 strikes the glass panel at some distance above the floor 1706. At the line 1710 where the water bell 1712 strikes the glass panel 1708 the flow will become turbulent and the water will cascade down the glass in a turbulent sheet 1714.

Figure 18:
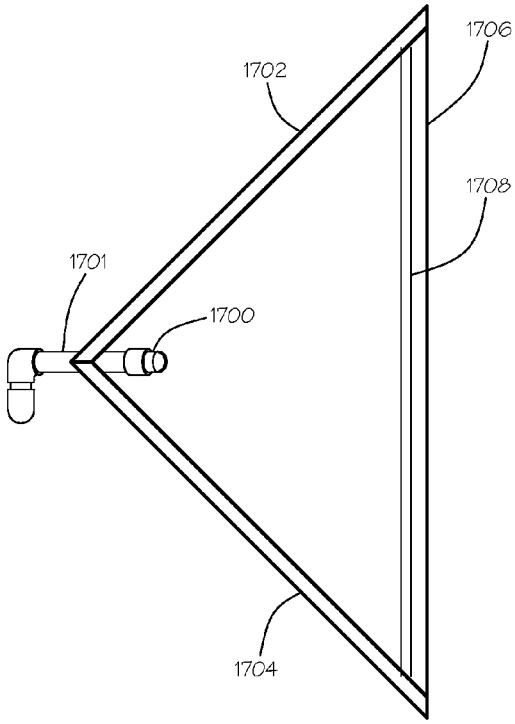
FIG. 18 is a plan view of the water display of FIG. 17.

FIG. 18 is a plan view of the water display of FIG. 17. In the embodiment illustrated the walls 1702, 1704 the walls are at right angles. Other angles may be used. In another embodiment, walls with reflective surfaces may be used to provide a kaleidoscopic display. The walls may be placed at a sixty degree angle to provide a traditional six-sided kaleidoscopic pattern. In the embodiment illustrated the nozzle 1700 lies on the bisector of the angle between the walls and the glass panel 1708 is perpendicular to the bisector. In other embodiments, the nozzle may be oriented more toward one of the walls. In other embodiments, the glass panel 1708 may not be perpendicular to the direction in which the nozzle 1700 emits water. In other embodiments, the nozzle may move and/or rotate to provide a dynamic display.

Figure 19:
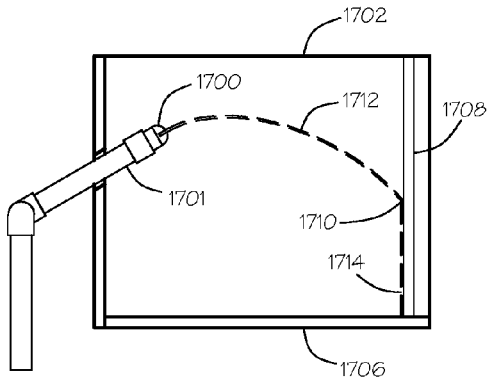
FIG. 19 is a side view of the water display of FIG. 17 with a wall removed for clarity.

FIG. 19 is a side view of the water display of FIG. 17 with one wall 1704 removed. In the embodiment illustrated the nozzle 1700 is directed upward at an angle of thirty degrees. In other embodiments, the nozzle may be oriented at greater or lesser angles, horizontal, or downward. In other embodiments, the glass panel 1708 may not be vertical and the top may be closer to or farther from the nozzle than the bottom.

Figure 20:
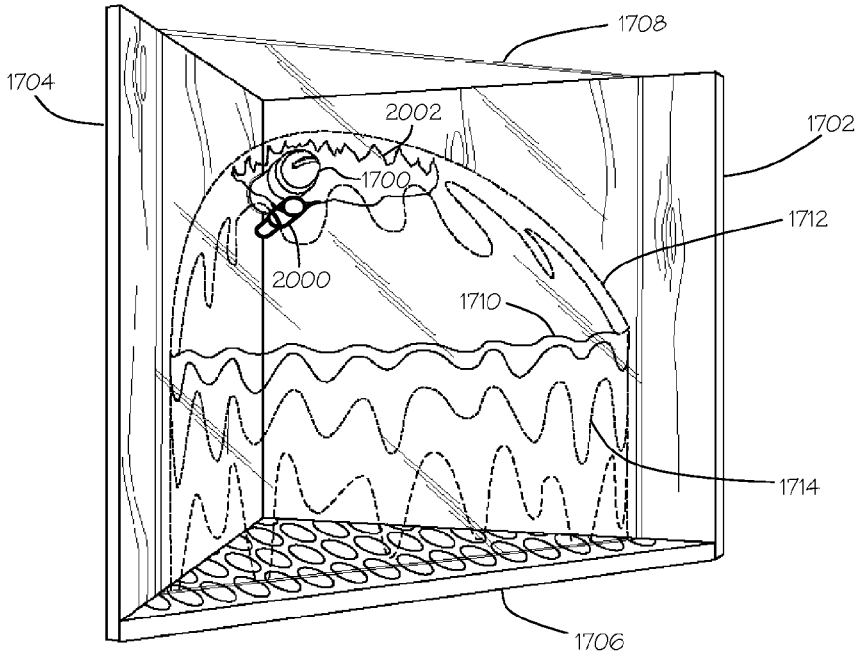
FIG. 20 is pictorial view of another configuration of a water display with a burner.
Figure 21:
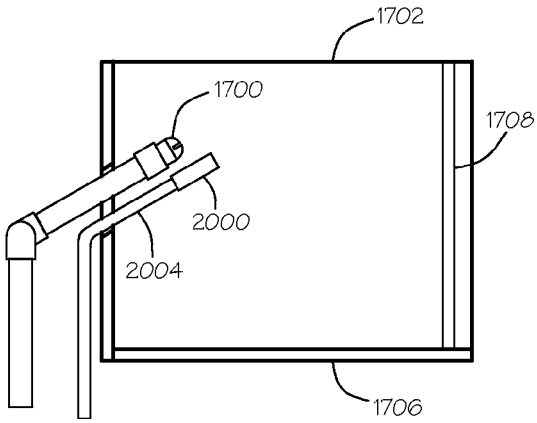
FIG. 21 is a side view of the water display of FIG. 20 with a wall removed for clarity.

FIG. 20 shows another water display similar to the embodiment of FIG. 17. In this embodiment a burner 2000 is added to provide a display that combines fire 2002 with the water bell 1712. The flame 2002 may be contained entirely within the water bell 1712 or it may break though the water bell as previously described for other embodiments. FIG. 21 is a side view of the water display of FIG. 20 with one wall 1704 removed. This illustrates one configuration for the burner 2000 supported on a supply tube 2004. Numerous other burner configurations may be used.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A decorative water display comprising:

a laminar nozzle having an outlet arranged to eject a laminar jet of water upwardly in a substantially vertical direction;

an impactor suspended directly above the outlet of the laminar nozzle such that the laminar jet of water forms a laminar water bell, the impactor being substantially flat and having a diameter of at least two inches, the impactor being suspended with sufficient rigidity to avoid movement or vibration that would disturb the laminar flow characteristics of the laminar water jet being impacted to produce the laminar water bell;

a container that encloses the laminar nozzle and collects water droplets from the laminar water bell as it breaks up and falls towards the laminar nozzle; and an upper surface in the container that obscures the laminar nozzle and drains to a lower portion of the container.

2. The decorative water display of claim 1 wherein the upper surface creates a shallow pool of water and provides a black bottom for the shallow pool of water.

3. The decorative water display of claim 1 wherein the upper surface supports a decorative surface through which the water droplets flow.

4. The decorative water display of claim 1 wherein the upper surface supports a barrier around the outlet of the laminar nozzle.

5. The decorative water display of claim 1 wherein the lower surface of the impactor has a concave shape.

6. The decorative water display of claim 5 wherein the impactor has a diameter between 2 and 3 inches and the lower surface has a depth at the center of ⅛ inch or less.

7. The decorative water display of claim 1 further comprising:

a supply line coupled to a source of flammable gas; and a burner supported by the supply line to be adjacent the laminar jet of water.

8. The decorative water display of claim 7 wherein the supply line extends vertically downward from the burner to be substantially parallel to the laminar jet of water.

9. The decorative water display of claim 1 wherein the impactor is suspended from a structure located above the laminar nozzle.

10. The decorative water display of claim 1 wherein the impactor is suspended from a support that extends from an adjacent vertical wall.

11. The decorative water display of claim 1 wherein the impactor is suspended from a support coupled to the laminar nozzle.

12. A method for creating a decorative water display, the method comprising:

ejecting water upwardly in a substantially vertical direction to create a laminar jet;

impinging the laminar jet on an impactor to produce a laminar water bell, the impactor being substantially flat and having a diameter of at least two inches; and collecting water droplets that fall from the laminar water bell in a container having an upper surface that obscures equipment used in the method and that drains to a lower portion of the container.

13. The method of claim 12 further comprising burning a flammable gas to create a flame within the laminar water bell.

14. The method of claim 12 further comprising collecting water droplets that fall from the laminar water bell to form a pool of water.

15. An apparatus for creating a decorative water display, the apparatus comprising:

means for ejecting water upwardly in a substantially vertical direction to create a laminar jet;

means for impinging the laminar jet on an impactor that is substantially flat and having a diameter of at least two inches to produce a laminar water bell; and means for collecting water droplets that fall from the laminar water bell, the means for collecting water droplets having an upper surface that obscures the means for ejecting water and that drains to a lower portion of the means for collecting water droplets.

16. The apparatus of claim 15 further comprising means for burning a flammable gas to create a flame within the laminar water bell.

17. The apparatus of claim 15 wherein the means for collecting water droplets forms a pool of water.

* * * * *